United States Patent [19]

Nittel et al.

[11] Patent Number: 4,582,783

[45] Date of Patent: Apr. 15, 1986

[54] PHOTOGRAPHIC SILVER HALIDE MATERIAL CONTAINING AN ANTISTATIC LAYER

[75] Inventors: Fritz Nittel; Bert Sauter, both of Leverkusen; Armin Voigt, Cologne, all of Fed. Rep. of Germany

[73] Assignee: Agfa-Gevaert Aktiengesellschaft, Leverkusen-Bayerwerk, Fed. Rep. of Germany

[21] Appl. No.: 727,551

[22] Filed: Apr. 26, 1985

[30] Foreign Application Priority Data

May 8, 1984 [DE] Fed. Rep. of Germany ..... 3416897

[51] Int. Cl.[4] ..... G03C 1/76

[52] U.S. Cl. ..... 430/529; 430/527; 430/538

[58] Field of Search ..... 430/527, 529, 538

[56] References Cited

U.S. PATENT DOCUMENTS

| | | | |
|---|---|---|---|
| 3,525,621 | 8/1970 | Miller | 430/529 |
| 3,769,020 | 10/1973 | Verburg | 430/529 |
| 4,268,623 | 5/1981 | Sera et al. | 430/529 |

*Primary Examiner*—Jack P. Brammer

*Attorney, Agent, or Firm*—Connolly and Hutz

[57] ABSTRACT

An antistatic layer applied to the back of the photographic material contains (A) a mixture of sodium magnesium silicate and the sodium salt of polystyrene sulphonic acid and (B) a succinic acid semi-ester compound. The antistatic layer is distinguished by high abrasion resistance and its good qualities as writing and printing surface.

5 Claims, No Drawings

PHOTOGRAPHIC SILVER HALIDE MATERIAL CONTAINING AN ANTISTATIC LAYER

This invention relates to a photographic material containing at least one silver halide emulsion layer on one side of a polyolefin-coated paper support and an antistatic layer on the other side of the support.

It is known to provide polyolefin-coated photographic paper with backing layers which impart antistatic properties to the material. The antistatic finish prevents the light-sensitive layers of a photographic material from being damaged by accidental, so-called "dendriform" exposure which may be caused by electric discharges, e.g. during transport of the material, during casting or packaging or in the processing apparatus. Static electric charges may be produced, for example, by the friction of the photographic material against the rollers or other parts of the apparatus through which the material passes or by contact with rough surfaces. The photographic material is then exposed by electrostatic discharges and irregular stripes or lines or dark points appear after photographic processing.

The surface of a photographic material may be prevented from being electrostatically charged by adding a matting agent to the protective layers to reduce the adherence between two materials in contact. If a charge has been built up, it may be removed by means of electrically conductive additives. A combination of the two methods may also be employed.

Numerous monomeric and polymeric compounds which are capable of developing an antistatic action either as electrolytes or by virtue of the matting effect thereof have been described as suitable for suppressing the static charging of photographic materials; see in this connection DE-OS Nos. 2,337,392; 2,359,553; 3,311,126; 2,513,791 and 2,534,976.

The known antistatic layers have the disadvantage that properties which are particularly important for photographic materials, especially materials which are to be processed mechanically, are either absent or insufficiently developed therein. These properties include a high resistance to abrasion against the transport rollers over which they travel during application of the emulsion layers or in the passage thereof through so-called "printers" and the capacity thereof to remain unaffected with regard to antistatic properties by the photographic processing liquids; moreover, the antistatic layers must be certain not to contaminate these liquids with constituents thereof and the layers must not stick even when subjected to high winding frictions. They must also form suitable surfaces for printing and writing with the conventional pastes or inks, including ball point pastes. One particularly troublesome characteristic of the known antistatic layers is the tendency thereof to pick up dirt in development machines using transport rollers. It is particularly in machines which are designed for processing sheet film and which contain textile-covered rollers that films of dirt consisting of developer oxidation products tend to be deposited on the back of the processed material, especially when the machine is starting up and if the output of the machine is low.

It is an object of the present invention to provide an antistatic layer which has the necessary abrasion resistance for mechanical processing of the photographic material and which forms a suitable surface for printing and writing and which, when used on sheet film, enables such material to be processed mechanically without the disadvantages described above.

The problem is solved according to the present invention by a photographic material containing at least one silver halide emulsion layer on one side of a polyolefin-coated paper support and an antistatic layer on the other side of the support, which material is characterised in that the antistatic layer contains:

(A) a mixture of sodium magnesium silicate and the sodium salt of polystyrene sulphonic acid;

and (B) a succinic acid semi-ester compound corresponding to one of the following general formulae I and II

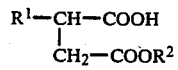

(I)

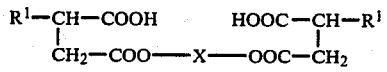

(II)

wherein $R^1$ represents an alkyl or alkenyl group having from 8 to 18 carbon atoms;

$R^2$ represents a substituted or unsubstituted cycloalkyl or aryl group, a condensed arylcycloalkyl group, an aralkyl group or one of the groups:

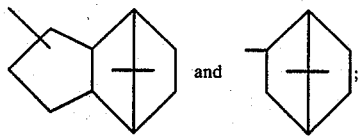

and

X represents cyclohexylene, alkylene

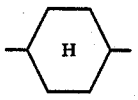

alkylene, cycloalkylene-alkylene-cycloalkylene or one of the groups:

$-CH_2-CH_2-(O-CH_2-CH_2-)_{3-7}$,

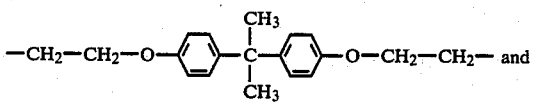

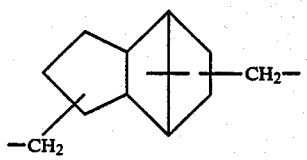

A condensed arylcycloalkyl group is understood to represent the radical of a condensed ring system comprising at least one aromatic carbocyclic ring and at least one non-aromatic carbocyclic ring, such as for example a group of the following structure

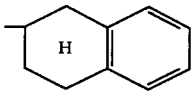

Sodium magnesium silicates suitable for use as antistatic agents (A) are available commercially. One eminently suitable sodium magnesium silicate has f.e. the following composition:

| | | |
|---|---|---|
| $SiO_2$ | 50.9%, | by weight |
| MgO | 24.2 | by weight |
| $Na_2O$ | 3.7 | by weight |
| $Li_2O$ | 1.8 | by weight |
| F | 4.7 | by weight |

The remainder is structurally-bound water.

The succinic acid semi-ester compounds B described are easily prepared by known methods and the moiety thereof $R^1$ has relatively little influence on those properties of the compounds which are of interest for present purposes.

In preferred succinic acid semi-ester compounds, hereinafter briefly referred to as succinic acid semi-esters, $R^1$ represents one of the monounsaturated aliphatic groups $-C_{12}H_{23}$, $-C_{15}H_{29}$ or $-C_{18}H_{35}$, the formation of which may be explained by the repeated addition of propylene.

The following compounds are given as examples of preferred succinic acid semi-esters:

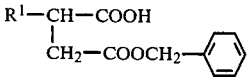
(1)

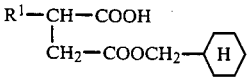
(2)

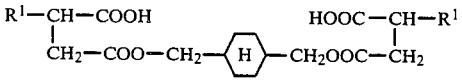
(3)

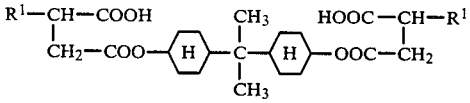
(4)

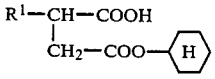
(5)

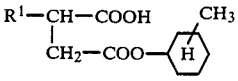
(6)

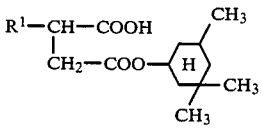
(7)

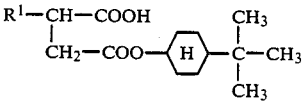
(8)

-continued

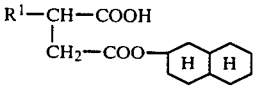
(9)

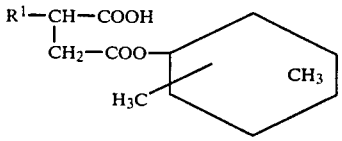
(10)

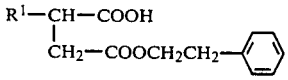
(11)

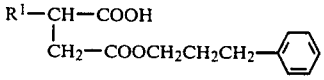
(12)

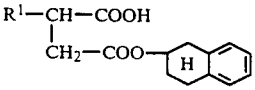
(13)

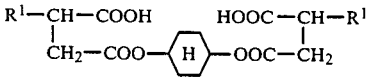
(14)

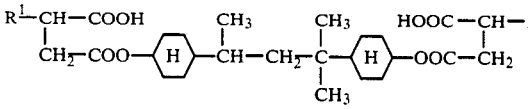
(15)

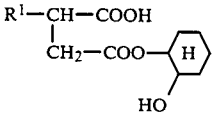
(16)

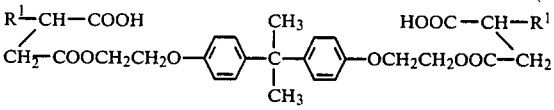
(17)

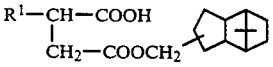
(18)

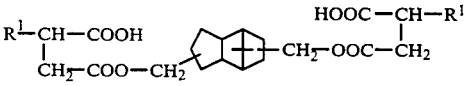
(19)

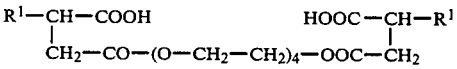
(20)

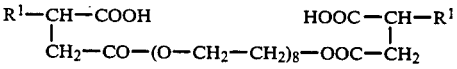
(21)

The preparation of succinic acid semi-esters is well known and may be carried out quite simply by the esterification of alcohols with succinic acid anhydrides with the aid of acidic or basic catalysts (e.g. diazabicyclooctane). The method of preparation has been described, for example, in BE-PS No. 745, 476, CA-PS No. 835, 420 and U.S. Pat. No. 3,689,271.

In the antistatic layers according to the present invention, the succinic acid semi-esters may be used singly or as mixtures. They are advantageously used in the form of oil/water emulsions. In combination with the sodium magnesium silicate, these emulsions provide exceptionally firmly adhering and abrasion-resistant layers.

The antistatic layer according to the present invention contains from 30 to 150 mg per $m^2$, preferably from 30 to 100 mg/$m^2$, of the mixture of sodium magnesium silicate and polystyrene sulphonic acid sodium (A) and from 40 to 200 mg/$m^2$, preferably from 80 to 120 mg/$m^2$, of succinic acid semi-ester (B).

The proportions in which the sodium magnesium silicate and polystyrene sulphonic acid sodium are mixed, given in parts, by weight, may range from 0.5:1 to 12:1 and is preferably from 4:1 to 7:1.

In addition to the above-mentioned components (A) and (B), the antistatic layer may contain the conventional additives for photographic auxiliary layers, e.g. natural or synthetic binders, such as proteins, cellulose derivatives, polysaccharides, polyvinyl alcohol or polyvinyl pyrrolidone, but especially gelatine; coating auxiliaries, such as wetting agents, matting agents or bactericidal agents, and thickeners, such as cellulose sulphate or carboxymethylcellulose. The conventional substances may be used as coating auxiliaries in the casting solutions of the antistatic layers according to the present invention, e.g. the sodium salts of sulphosuccinic acid dioctyl ester, dibutylnaphthalene sulphonic acid, triisopropylanphthalene sulphonic acid and especially dodecylbenzene sulphonic acid.

The present antistatic layers are applied to the back of the photographic layer support by the conventional methods, such as immersion, spraying or blade coating. A preliminary treatment is advisable for better adherence, e.g. corona irradiation according to DE-AS No. 1,159,159. After application of the antistatic layer according to the present invention, the light-sensitive photographic silver halide emulsion layer and auxiliary layers may be applied to the other side of the layer support.

The layer supports used may be paper coated with polymers of an α-olefin containing from 2 to 20 carbon atoms, e.g. polyethylene, polypropylene or copolymers of ethylene and propylene.

The antistatic layers according to the present invention are suitable both for black-and-white materials and for colour photographic materials. The properties of the photographic layers are in no way adversely affected by the present antistatic layer.

At the same time, the antistatic properties of the layers according to the present invention are not impaired by the processing liquids used for the photographic materials nor are these processing liquids affected by constituents of the present antistatic layers. The antistatic layers have excellent abrasion resistance and are therefore advantageously used for photographic materials intended to be processed in machines equipped with textile rollers.

The following Examples serve to illustrate the use of the antistatic layers described here.

1. Preparation of the aqueous emulsion, ready for use, of a succinic acid semi-ester 30 g of gelatine are dissolved in 9.97 l of distilled water at 40° C. 40 g of an 80%, by weight, aqueous phenol solution are then added.

Into this solution is then stirred a solution of 3 kg of succinic acid semi-ester and 75 g of sodium dodecylbenzene sulphonate in 3 kg of diethylcarbonate at 40° C., using a high speed stirrer apparatus. When the solutions have been added together, the mixture obtained is homogenized in a suitable apparatus at 80 bar and the auxiliary solvent used is then distilled off.

Preparation of antistatic casting solutions 2.1 The following are introduced successively, with stirring, into 7.26 kg of deionised water: 0.8 kg of an aqueous emulsion of succinic acid semi-ester No. 1 ($R^1=C_{18}H_{35}$) prepared to 1 above, 1.23 kg of sodium magnesium silicate (10% in water) 0.44 kg of polystyrene sulphonic acid sodium (5% in water) and 0.27 kg of dodecylbenzene sulphonic acid sodium (4% in water).

2.2 The composition of antistatic casting solution 2.1 is modified as follows:

| | |
|---|---|
| Deionised water | 6.47 kg |
| Succinic acid semi-ester No. 1 ($R^1 = C_{18}H_{35}$) | 1.2 kg |
| Sodium magnesium silicate (10%) | 1.84 kg |
| Polystyrene sulphonic acid sodium (5%) | 0.33 kg |
| Dodecylbenzene sulphonic acid sodium (4%) | 0.16 kg |

2.3 The composition of solution 2.1 is modified as follows:

| | |
|---|---|
| Deionised water | 8.33 kg |
| Succinic acid semi-ester No. 6 ($R^1 = C_{18}H_{35}$) | 0.3 kg |
| Sodium magnesium silicate (10%) | 0.4 kg |
| Polystyrene sulphonic acid sodium (5%) | 0.7 kg |
| Dodecylbenzene sulphonic acid sodium (4%) | 0.27 kg |

2.4 The composition of solution 2.1 is modified as follows:

| | |
|---|---|
| Deionised water | 8.88 kg |
| Succinic acid semi-ester No. 7 ($R^1 = C_{18}H_{35}$) | 0.3 kg |
| Sodium magnesium silicate (10%) | 0.2 kg |
| Polystyrene sulphonic acid sodium (5%) | 0.35 kg |
| Dodecylbenzene sulphonic acid sodium (4%) | 0.27 kg |

2.5 The composition of solution 2.1 is modified as follows:

| | |
|---|---|
| Deionised water | 6.83 kg |
| Succinic acid semi-ester No. 18 ($R^1 = C_{18}H_{35}$) | 0.9 kg |
| Sodium magnesium silicate (10%) | 0.4 kg |
| Polystyrene sulphonic acid sodium (5%) | 1.6 kg |
| Dodecylbenzene sulphonic acid sodium (4%) | 0.27 kg. |

3. Preparation of the antistatic layer

Each of the casting solutions 2.1 to 2.5 is separately cast on the back of a polyethylene-coated paper support which has previously been subjected to a corona treatment. The application of the layer is adjusted by means of a doctor blade so that 5 g of casting solution are applied per $m^2$. The thus-prepared layer are then dried.

4. Test method

The tendency of an antistatic layer to pick up dirt as the photographic material passes through a processing machine is tested as follows: A textile roller clothed with a polypropylene fabric and in contact with a steel contact pressure roller is dipped in a developer contained in a dish. The textile roller is driven by a motor. The developer is circulated over a thermostat so that it is maintained at a temperature of 30° C. The developer used for the test is one through which air has been passed for 2 days as preparation for the test. The degree to which dirt is picked up is assessed according to a numerical scale ranging from 1 (severe soiling) to 5 (no visible soiling). 1 liter of the developer contains:

| | |
|---|---|
| Oleic acid-N—methyl tauride, sodium salt | 0.05 g |
| Diethylene glycol | 50.0 ml |
| Benzyl alcohol | 20.0 ml |
| White toner (sodium salt) | 1.5 g |
| Fluortensid 4% | 0.13 ml |
| Caprolactam | 5.0 g |
| 4-amino-N—ethyl-N—(3-methylsulphonamido-ethyl)-m-toluidine | 6.6 g |
| 1-hydroxy-ethane-1,1-diphosphonic acid, disodium salt | 0.16 g |
| Hydroxylamine sulphate | 6.0 g |
| Nitrilotriacetic acid sodium salt | 0.6 g |
| Diethylene triamine pentacetic acid sodium salt | 0.77 g |
| Potassium carbonate | 34.0 g |
| Potassium hydroxide | 3.6 g |

The apparatus described above is used as follows for testing the samples:

The test samples (9×23 cm) are passed through the apparatus longitudinally with the antistatic layer facing the textile roller.

The samples are then washed under running water and dried and the amount of dirt taken up is assessed.

The abrasion is tested as follows: 1200 m of a material 8.9 cm in width which has been provided with the antistatic layer according to the present invention are passed through a commercial colour printer. When the length of material has travelled through the apparatus, the surface of the rollers which have been in contact with the antistatic layer are examined and the quantity of abrasion dust left on the surface is assessed by grades 1 to 5, where grade 1 denotes "severe abrasion" and 5 denotes "no abrasion".

The suitability of the antistatic layers as printing and writing surface is tested as follows: Typewriter characters are typed on the back of the material covered with antistatic layer, using a black typewriter ribbon, and characters are also written on this surface using a ball pen. If the types and the lettering are perfect, the result is assessed as 5. Poorer results are graded 4 to 1.

The surface resistance was determined according to DIN 53482.

TABLE 1

| Antistatic layer | Wet application g/$m^2$ | Solids application mg/$m^2$ | Surface resistance (Ω/cm) at 50% r.h. after 16 hours air conditioning | Quality of printing/writing surface | Abrasion | Dirt absorption |
|---|---|---|---|---|---|---|
| Without layer | — | — | $10^{14}$ | 1 | — | 1 |
| Casting solution 2.1 | 5 | 170 | $2.2 \times 10^8$ | 5 | 5 | 5 |
| Casting solution 2.2 | 5 | 242 | $1.1 \times 10^8$ | 5 | 5 | 5 |
| Casting solution 2.3 | 5 | 77 | $9.5 \times 10^7$ | 4 | 5 | 5 |
| Casting solution 2.4 | 5 | 59 | $9.0 \times 10^9$ | 5 | 5 | 5 |
| Casting solution 2.5 | 5 | 169 | $1.0 \times 10^8$ | 4 | 5 | 5 |
| Casting solution 2.2 diluted with x l of water | | | | | | |
| 3 | 5.2 | 186 | $2.5 \times 10^8$ | 5 | 5 | 5 |
| 6 | 5.2 | 151 | $4.8 \times 10^8$ | 5 | 5 | 5 |
| 9 | 5.1 | 127 | $9.0 \times 10^8$ | 5 | 5 | 5 |
| 12 | 5.0 | 110 | $8.5 \times 10^9$ | 5 | 5 | 5 |

It will be seen from the results summarized in the above Table that the composition of the antistatic layers according to the present invention and the amount applied may be varied considerably without a loss in the advantageous properties of the layers.

Similarly advantageous results are obtained when —$C_{18}H_{35}$ represented by $R^1$ in the succinic acid semi-esters used is replaced by one of the groups —$C_{12}H_{23}$ or —$C_{15}H_{29}$ mentioned on page 6.

Comparison example:

The properties of antistatic layers according to the present invention are compared with those of layers which, instead of containing succinic acid semi-esters, contain the latices conventionally used for the preparation of antistatic layers.

(a) Antistatic layers according to the present invention.

Using casting composition 2.1 indicated above, antistatic layers are prepared containing succinic acid semi-esters No. 1, No. 3, No. 5 or No. 14, respectively.

(b) Antistatic layers containing latex.

Casting composition:

| | |
|---|---|
| Deionised water | 7.29 kg |
| Sodium magnesium silicate (10%) | 1.23 kg |
| Polystyrene sulphonic acid sodium (5%) | 0.44 kg |
| Dodecylbenzene sulphonic acid sodium (4%) | 0.16 kg |
| Latex (30%, by weight, solids content) | 0.88 kg |

The results are shown in Table 2 below. The latices used for the comparison are indicated in the Table. The latices which are obtained commercially having solids contents of from 33 to 55%, by weight, were used in each case at a concentration of 30%, by weight.

TABLE 2

| | Wet application g/m² | Solids application mg/m² | Surface resistance (Ω/cm) at 50% r.h. after 16 hours air conditioning | Quality of printing/writing surface | Abrasion | Dirt absorption |
|---|---|---|---|---|---|---|
| Succinic acid semi-ester | | | | | | |
| No. 1 ($R^1 = C_{18}H_{35}$) | 5.0 | 170 | $1.1 \times 10^8$ | 5 | 5 | 4–5 |
| No. 3 ($R^1 = C_{18}H_{35}$) | 5.2 | 176 | $4 \times 10^8$ | 5 | 5 | 5 |
| No. 5 ($R^1 = C_{18}H_{35}$) | 5.1 | 172 | $3.8 \times 10^8$ | 5 | 5 | 4–5 |
| No. 14 ($R^1 = C_{18}H_{35}$) | 5.0 | 170 | $2.7 \times 10^8$ | 5 | 5 | 5 |
| Latex: | | | | | | |
| Polyvinyl chloride | 5.2 | 216 | $6.2 \times 10^8$ | 4 | 2 | 1 |
| Polyurethane | 5.0 | 208 | $5 \times 10^8$ | 5 | 1 | 1 |
| Polyethylene | 5.3 | 220 | $1 \times 10^9$ | 5 | 2 | 1–2 |
| Polyethylacrylate | 5.0 | 208 | $8.2 \times 10^8$ | 5 | 1 | 1 |
| Polybutylacrylate | 5.2 | 216 | $4 \times 10^8$ | 5 | 1 | 1 |
| Copolymer containing butadiene and alkylacrylate units | 5.3 | 220 | $7 \times 10^8$ | 5 | 1 | 1 |

We claim:

1. Photographic material containing at least one silver halide emulsion layer on one side of a polyolefin-coated paper support and an antistatic layer on the other side of the support, characterised in that the following are contained in the antistatic layer:

(A) a mixture of a sodium magnesium silicate and the sodium salt of polystyrene sulphonic acid; and (B) a succinic acid semi-ester compound corresponding to one of the following general formulae:

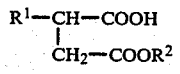

(I)

and

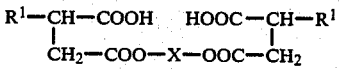

(II)

wherein $R^1$ represents an alkyl or alkenyl group having from 8 to 18 carbon atoms;

$R^2$ represents a substituted or unsubstituted cycloakyl or aryl group, a condensed arylcycloalkyl group, an aralkyl group, or one of the groups:

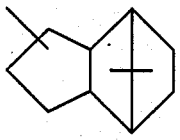

and

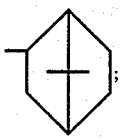

;

and

X represents cyclohexylene, alkylene

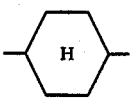

alkylene, cycloalkylene-alkylene-cycloalkylene, or one of the groups:

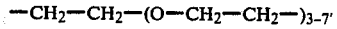

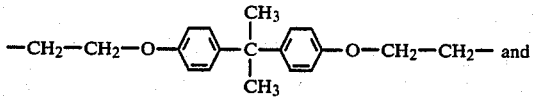

and

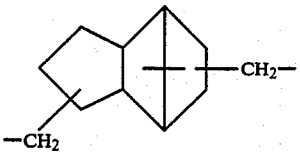

2. Material as claimed in claim 1, wherein the antistatic layer contains from 30 to 150 mg/m² of mixture (A) and from 40 to 200 mg/m² of succinic acid semi-ester compound (B), the proportions in which the sodium magnesium silicate and the sodium salt of polystyrene sulphonic acid are mixed being from 0.5:1 to 12:1.

3. Material as claimed in claim 1 wherein the antistatic layer contains a succinic acid semi-ester compound (I) wherein $R^2$ represents an alkyl-substituted cycloalkyl group.

4. Material as claimed in claim 3, wherein the cycloalkyl group contains from 1 to 3 methyl groups or a tertiary butyl group as substituents.

5. Material as claimed in claim 1, wherein the antistatic layer contains a succinic acid semi-ester compound corresponding to the following general formula:

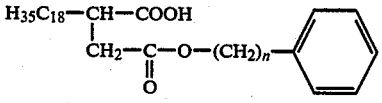

wherein n represents an integer of from 1 to 3.

* * * * *